United States Patent [19]

Maeda

[11] Patent Number: 4,479,635

[45] Date of Patent: Oct. 30, 1984

[54] IDLING DEVICE FOR LEVER HOIST

[75] Inventor: Kazuo Maeda, Yokohama, Japan

[73] Assignee: Kabushiki Kaisha Kito, Kawasaki, Japan

[21] Appl. No.: 473,305

[22] Filed: Mar. 8, 1983

[30] Foreign Application Priority Data

Jun. 7, 1982 [JP] Japan ..... 57-96294

[51] Int. Cl.[3] ..... B66D 1/14; B66D 5/32

[52] U.S. Cl. ..... 254/350; 192/114 R; 254/353; 254/376

[58] Field of Search ..... 254/350, 352, 353, 368, 254/369, 372, 376, 380; 192/114 R, 95, 14

[56] References Cited

U.S. PATENT DOCUMENTS

| | | | |
|---|---|---|---|
| 2,417,492 | 3/1947 | Hinchcliffe | 254/376 X |
| 2,690,240 | 9/1954 | Schroeder | 254/372 X |
| 3,047,114 | 7/1962 | Stevens, Jr. | 254/350 X |
| 3,100,031 | 8/1963 | Lock | 254/350 X |

FOREIGN PATENT DOCUMENTS

| | | | |
|---|---|---|---|
| 660281 | 11/1951 | United Kingdom | 254/376 |

*Primary Examiner*—Stuart S. Levy
*Assistant Examiner*—Katherine Jaekel
*Attorney, Agent, or Firm*—Sughrue, Mion, Zinn, Macpeak & Seas

[57] ABSTRACT

An idling device is able to bring into an idling condition a lever hoist including a change gear provided on driving member threadedly engaged on a driving shaft for driving a sheave for winding-up a chain or rope for a load, an operating lever rockably driven by a hand, winding-up and winding-off driving pawls engageable with teeth of the change gear and changeable in response to the purpose of hoisting or lowering the load, and a braking assembly for preventing the change gear from being driven by a gravity of the load and adapted to be clamped and released by rotative movement of the driving member relative to said driving shaft. According to the invention the idling device comprises a change-over knob fitted on the driving shaft axially slidably but against rotation and a manually operatable knob fitted on and rotatably and axially slidably relative to the driving shaft between the change-over knob and the driving member and provided with engagement recesses adapted to be engaged in protrusions formed in the driving member. The manually operatable knob is formed with engagement recesses in a bottom of its cavity for receiving the change-over knob. The change-over knob is formed with engagement protrusions to be received in the engagement recesses of the manually operatable knob in the idling condition. The manually operatable knob is further formed with engagement surfaces in opposition to the engagement protrusions of the change-over knob for preventing the change-over knob from moving away from the driving member.

9 Claims, 6 Drawing Figures

IDLING DEVICE FOR LEVER HOIST

BACKGROUND OF THE INVENTION

1. Field of the Invention:

The present invention relates to an idling device for a lever hoist capable of maintaining its braking assembly in a released condition during idling operation of the hoist but making the assembly clamped or operative in lifting and lowering a load.

2. Description of the Prior Art:

Idling devices for lever-operated small type hoisting and dragging devices have been known. One of the devices includes a spring interposed between a driving member repeatedly driven by a lever and a driven member of a braking assembly for releasing a braking assembly.

With the known device, as a spring force always acts in a direction releasing the braking assembly, a clamping force for the braking assembly is insufficient when a light load is being hoisted. In hoisting such a light load, therefore, when the lever is repeatedly rocked, the driving member is returned by a return movement of the lever for a next driving movement. Accordingly, such a device cannot hoist the light load. In lowering a light load, on the other hand, a torque resulting from the light load turns a load sheave to cause the load to drop, with the result that such a light load cannot be lowered by the rocking movement of the lever.

SUMMARY OF THE INVENTION

It is an object of the invention to provide an improved idling device for a lever hoist which eliminates the above disadvantages of the prior art and is capable of lifting and lowering even a light load by repeatedly rocking a lever by providing a particular knobs.

An idling device for a lever hoist including a change gear provided on a driving member threadedly engaged on a driving shaft for driving a sheave winding up a chain, rope or the like thereabout for a load, an operating lever rockable about said driving member by a hand, a winding-up driving pawl engageable with teeth of said change gear and driven by said operating lever in a winding-up direction for the load, a winding-off driving pawl engageable with the teeth of said change gear and driven by said operating lever in a winding-off direction for the load, and a braking assembly preventing said change gear from being driven from a side of said sheave and being clamped and released by rotative movement of said driving member relative to said driving shaft, according to the invention said device comprises a change-over knob fitted on said driving shaft axially slidably but against rotation relative thereto at one end of said shaft on an opposite side of said braking assembly with respect to said change gear, and a manually operatable knob fitted on and rotatable and axially slidable relative to said driving shaft between said change-over knob and said driving member and provided with rotative movement transmitting means for transmitting rotative movement between said manually operatable knob and said driving member, and said knobs comprising holding means for holding said manually operatable knob relative to said change-over knob to prevent said manually operatable knob from rotating relative to said driving shaft and hence prevent said driving member from clamping said braking assembly.

The invention will be more fully understood by referring to the following detailed specification and claims taken in connection with the appended drawings.

DETAILED DESCRIPTION OF THE PREFERRED EMBODIMENT

Figure 1:
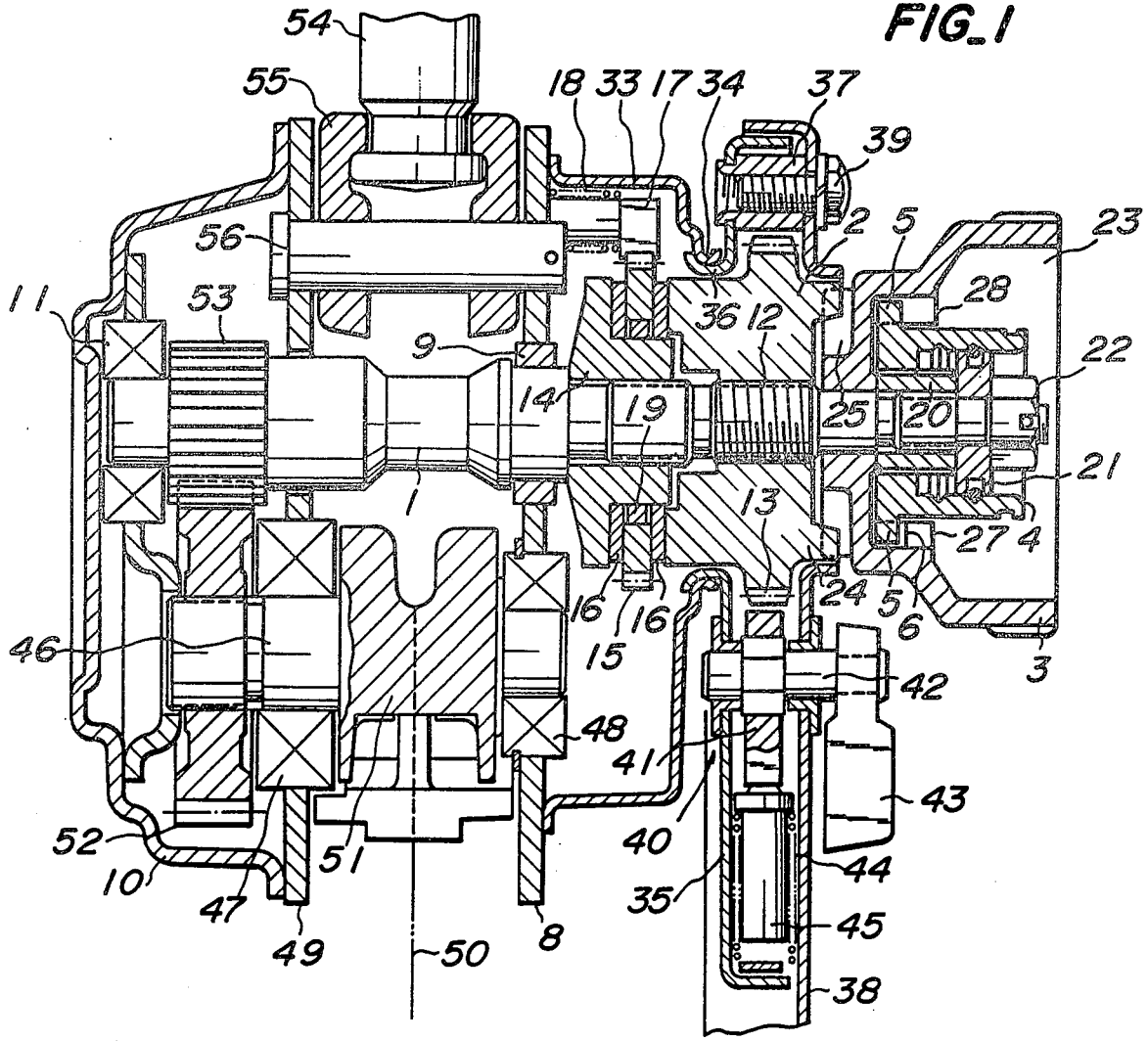
FIG. 1 is a sectional view of a part of a lever hoist under an operated condition provided with an idling device according to the invention.

Referring to FIGS. 1–6 illustrating one embodiment of the invention, a driving shaft 1 is journaled at its mid portion by a bearing 9 in a frame 8 and has a front end (left end as viewed in FIG. 1) journaled by a bearing 11 in a gear box 10 and a rear portion formed with external screw threads 12 for a braking assembly adapted to be threadedly engaged with internal screw threads of a driving member 2 having change gear teeth 13. A driven member 14 is also fitted on the driving shaft 1 against rotation relative thereto between the frame 8 and driving member 2 and abuts against an enlarged diameter portion of the driving shaft 1 journaled by the bearing 9.

In the specification, the word "front" or "forward" means the side of a sheave of the lever hoist or the left side as viewed in FIG. 1, while the word "rear" means the side of an operating lever or the right side as viewed in FIG. 1.

Between the driving member 2 and the driven member 14 are interposed a brake ratchet wheel 15 and friction plates 16 abutting against opposite sides thereof. A brake pawl 17 pivotally secured to the frame 8 is brought into engagement with the brake ratchet wheel 15 by an engagement spring 18. The brake ratchet wheel 15 has a center hole within which is fitted an oilless bearing 19 of a sintered alloy. The ratchet wheel 15, friction plates 16 and bearing 19 are fitted on a reduced diameter portion of the driven member 14 to form a braking assembly. In hoisting and lowering a heavy load, the driving shaft 1 tends to be rotated by a gravity of the load, so that when the driving shaft 1 is rotated, the driving member 2 is moved toward the braking assembly or to the left as viewed in FIG. 1 because of the threaded engagement of the driving shaft 1 and driving member 2. Accordingly, the driving member 2 urges the ratchet wheel 15 and friction plates 16 against the driven member 14 so that the driving shaft 1 is prevented from rotating with the aid of the brake pawl 17 connected to the frame 8.

A cylindrical knob guide 20 is fitted on a reduced diameter portion at a rear or right end of the driving shaft 1 against rotation and a support member 21 is also fitted on a reduced diameter portion of the driving shaft adjacent to the above reduced diameter portion. The guide 20 and support member 21 are fixed at the rear end of the driving shaft 1 by means of a nut threadedly engaged on the rear end of the driving shaft 1 and locked by a split pin.

A manually operatable knob 3 for manually quickly rotating the driving shaft 1 is formed with a cavity 23 for receiving a change-over knob 4 later described and is fitted on rotatably and somewhat axially slidably rotative to the driving shaft 1. The driving member 2 is formed with engagement protrusions 24 on its rear end surface which are adapted to be fitted in engagement recesses 25 formed in a front end surface of the knob 3 to form a rotative movement transmission portion for transmitting the rotative movement between the driving member 2 and the knob 3. There is a clearance between the driving member 2 and the knob 3 to permit the braking assembly to release.

Figure 3:
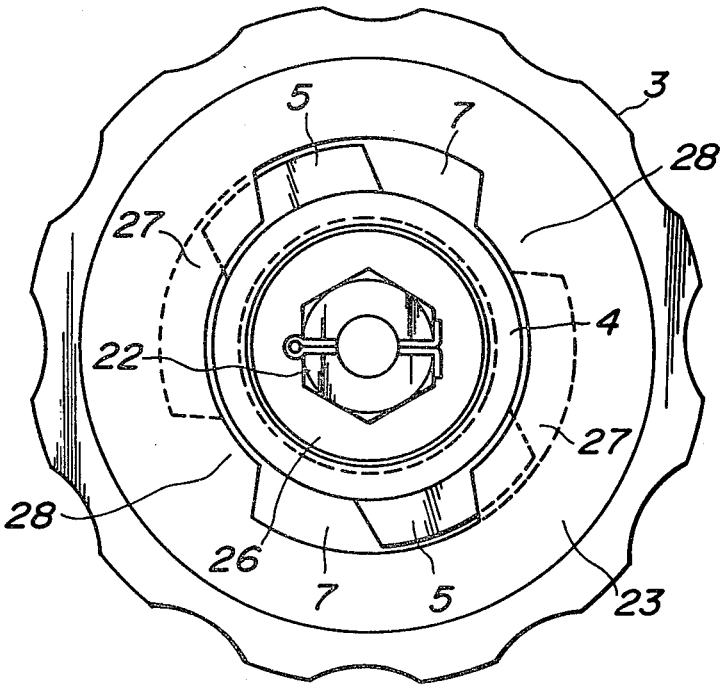
FIG. 3 is a side view of a part of the idling device shown in FIG. 1.
Figure 4:
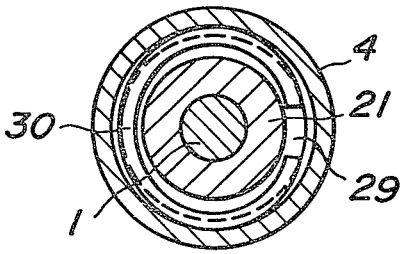
FIG. 4 is a sectional view taken along a line IV—IV in FIG. 2.
Figure 5:
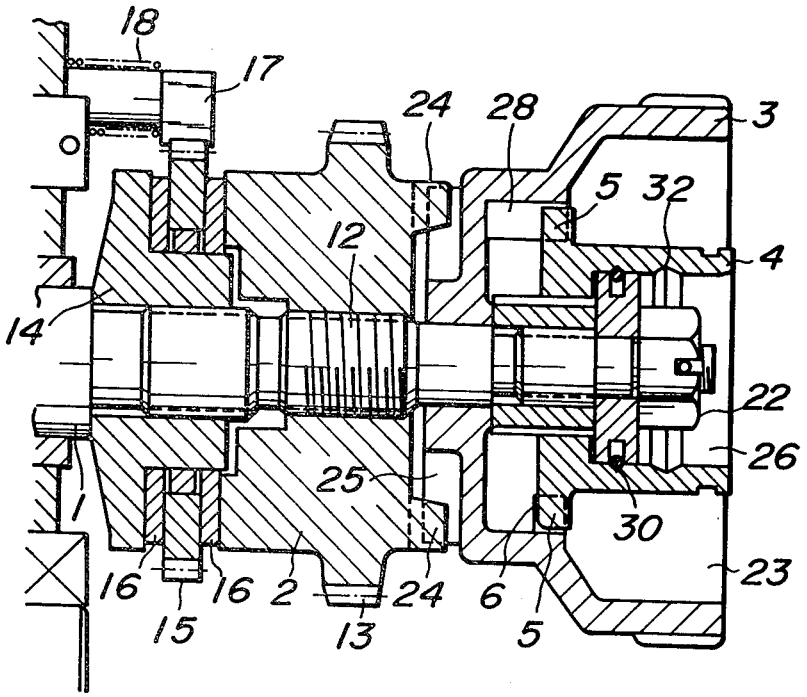
FIG. 5 is a sectional view of the idling device under an idling condition according to the invention.
Figure 6:
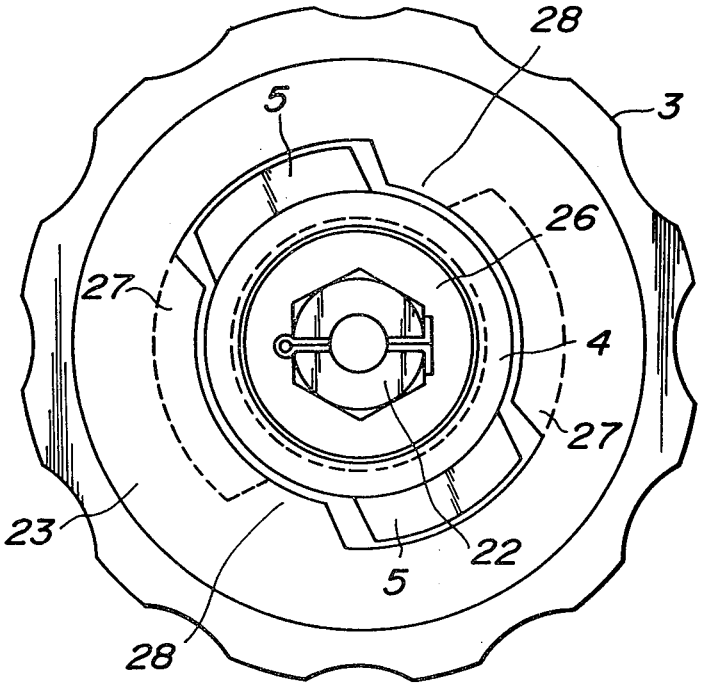
FIG. 6 is a side view of a part of the idling device shown in FIG. 5.

The change-over knob 4 is formed with a cavity 26 for snugly receiving the support member 21 and is fitted on the knob guide 20 axially slidably but against rotation relative thereto. The change-over knob 4 is further formed integrally with a plurality of engagement protrusions 5 circumferentially equally spaced with each other. The knob 3 is integrally formed in the cavity 23 with a plurality of engagement projections 27 circumferentially equally spaced with each other for preventing the change-over knob 4 from retracting or moving away from the driving member 2. Each of the engagement projections 27 has an engagement surface 6 for preventing the change-over knob 4 from retracting or moving away from the driving member 2. The engagement surfaces 6 of the projections 27 form with a bottom surface of the cavity 23 a space for receiving the engagement protrusions 5 of the change-over knob 4. The knob 3 is further integrally formed in the cavity 23 with plurality of stoppers 28 circumferentially equally spaced with each other which are adapted to engage side surfaces of the engagement protrusions 5 of the change-over knob 4 to prevent an excess release of the braking assembly when the knob 3 is rotated to an idling position for the braking assembly. The stoppers 28 and the protrusions 27 form therebetween engagement recesses 7 for inserting and removing the engagement protrusions 5 therethrough (FIG. 3). Moreover, the stoppers 28 form spaces with the other side surfaces of the protrusions 5 for permitting the knob 3 to be rotated in a brake clamping direction.

Figure 2:
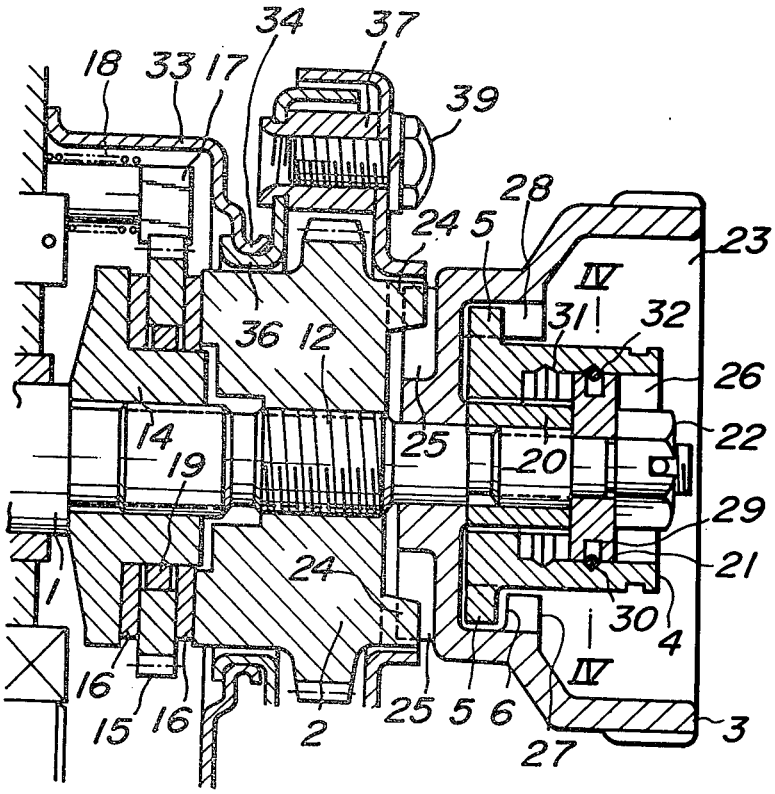
FIG. 2 is an enlarged sectional view of a part of the lever hoist shown in FIG. 1.

The support member 21 is formed in its outer circumferential surface with an annular groove 29 in which a partially cut-off annular metal spring 30 is fitted. The change-over knob 4 is formed in the cavity 26 with annular engagement grooves 31 and 32 adapted to detachably receive the spring 30 for determining the idling position and non-idling position of the change-over knob 4 (FIG. 2).

The driven member 14, brake ratchet wheel 15, friction plates 16, brake pawl 17 and front part of the driving member 2 are covered by a metal brake cover 33 formed on its rear side by pressforming with a fixed support ring 34 having a U-shaped cross-section in opposition to an outer intermediate circumferential surface of the driving member 2. An inner lever component member 35 made of metal plates is formed by pressforming with a rotatable support ring 36 on its intermediate portion adjacent to the brake cover 33. The support ring 36 is adapted to be fitted in the fixed support ring 34 rotatable but against axial movement relative thereto in a manner enclosing the support ring 34. Cylindrical spacers 37 having internal screw threads are fitted and fixed by calking in apertures of the bottom portion of inner and outer lever component members 35 and 38 which are joined by connecting bolts 39 threadedly engaged within the spacers 37 to form an operating lever 40 rockable about a center line of the change gear 13.

The brake cover 33 is fixed on its side opposite to the fixed support ring 34 to the frame 8 by means of bolts (not shown). A handle or knob 43 is fixed to a pivot shaft 42 rotatably supported in the operating lever 40. To the pivot shaft 42 rotatably supported in the operating lever 40 is fixed a change-over pawl member 41 including a winding-up direction driving pawl and a winding-off direction driving pawl which are detachably engageable with the change gear 13 and a winding-up direction holding engagement portion, a winding-off direction holding engagement portion and a neutral position holding engagement portion. The change-over pawl member 41 is engaged with a holding member 45 adapted to be urged thereto by means of an engagement or urging spring 44.

A driven shaft 46 is arranged in parallel with and under the driving shaft 1. A mid portion of the driven shaft 46 is journaled in a bearing 47 in a frame 49 closing an opening of a gear box 10 and a rear end of the shaft 46 is journaled in a bearing 48 in the frame 8. The driven shaft 46 is formed integrally with a load sheave 51 between the frames 8 and 49 for winding a chain 50 (symbolically shown in a chain line in FIG. 1) thereabout. In the gear box 10, the driven shaft 46 is provided with a large gear 52 fixed thereto adapted to engage a pinion 53 formed in the front end of the driving shaft 1.

In FIG. 1, an upper hook 54 is anchored to a hook support metal 55 mounted on a support rod 56 extending between the frames 8 and 49.

In carrying out the invention, the protrusion 5, recess 7, protrusion 27 and stopper 28 may be only each one of them. If two or more sets of them are provided, they need not be arranged with equal intervals. The annular spring 30 for determining the positions of the knob 4 may be a rubber ring.

In the above embodiment, the engagement protrusions 24 are formed on driving member 2, while the engagement recesses 25 are formed in the knob 3. As an alternative, the engagement recesses may be formed in the driving member 2, while the engagement protrusions may be formed on the knob 3. Moreover, the driving member 2 and the knob 3 may be integrally formed in a unitary member. In this case, the maximum external diameter of the knob 3 must be smaller than the inner diameter of the boss of the outer lever component member 38 and there must be a clearance between a front surface of the knob guide 20 and a rear surface of the fitted portion of the knob 3 on the driving shaft 1 for permitting the release of the braking assembly.

According to the invention, starting from a condition wherein the driving shaft 1 is held so as not to rotate by gripping the load chain 50 or other means, the knob 3 together with the driving member 2 is rotated in a brake releasing direction to bring the engagement recesses 7 of the knob 3 into alignment with the engagement protrusions 5 of the change-over knob 4 and then the knob 4 is retracted to insert the protrusions 5 into the recesses 7. In this manner, the braking assembly can be simply kept in the released condition, so that the idling operation of the hoist can be effected by rotating the knob 3 or pulling the load chain 50. Moreover, after the change-over knob 4 is moved forward or toward the left as viewed in FIG. 1 to remove the protrusions 5 from the recesses 7 and hence to release the rotative connection between the knobs 3 and 4, the knob 3 is rotated in a brake clamping direction to bring the protrusions 5 of the change-over knob 4 into front of the engagement surfaces 6 of the knob 3, so that the braking assembly is changed from the idling or released condition into the clamped or operating condition, thereby lifting and lowering a light load without any trouble. In this case, the above operation for rotating the knob 3 in the brake clamping direction is not necessarily needed, because a next operation of the lever 40 causes the knob 4 to move into the brake clamping direction. Furthermore, when the braking assembly is changed from the idling or released condition to the clamped or operating condition, the engagement surfaces 6 of the knob 3 are arranged behind the protrusions 5 of the change-over knob 4, thereby preventing the knob 4 from moving into the idling position and thereby the changing over of the braking assembly into the idling or released condition due to an error or unintentional operation in lifting or lowering a load.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An idling device for a lever hoist including a change gear provided on a driving member threadedly engaged on a driving shaft for driving a sheave winding up a chain, rope or the like thereabout for a load, an operating lever rockable about said driving member by hand, a winding-up driving pawl engageable with teeth of said change gear and driven by said operating lever in a winding-up direction for the load, a winding-off driving pawl engageable with the teeth of said change gear and driven by said operating lever in a winding-off direction for the load, and braking means for preventing said change gear from being driven from said sheave, said braking means being clamped and released by rotative movement of said driving member relative to said driving shaft, said device comprising a change-over knob fitted on said driving shaft axially slidably but against rotation relative thereto at one end of said shaft on an opposite side of said braking assembly with respect to said change gear, and a manually operatable knob fitted on and rotatable and axially slidable relative to said driving shaft between said change-over knob and said driving member and provided with rotative movement transmitting means for transmitting rotative movement between said manually operatable knob and said driving member and said knobs comprising holding means for holding said manually operatable knob relative to said change-over knob to prevent said manually-operatable knob from rotating relative to said driving shaft and hence prevent said driving member from clamping said braking assembly.

2. An idling device as set forth in claim 1, wherein said rotative movement transmitting means comprises engagement protrusions and recesses for receiving said protrusions formed in opposite surfaces of said driving member and said manually operatable knob, respectively.

3. An idling device as set forth in claim 1, wherein said holding means comprises protrusions formed on said change-over knob and recesses formed in said manually operatable knob.

4. An idling device as set forth in claim 1, wherein said manually operatable knob comprises means for preventing said change-over knob from moving away from said driving member, thereby preventing said braking assembly from releasing in lifting and lowering a load.

5. An idling device as set forth in claim 4, wherein said holding means comprises engagement protrusions formed on said change-over knob equally spaced in a circumferential direction of said knob and engagement recesses formed in said manually operatable knob equally spaced in a circumferential direction of said knob, and said manually operatable knob is formed integrally with a plurality of engagement projections on a bottom of a cavity for receiving therein said change-over knob, said engagement projections equally spaced in a circumferential direction of said manually operatable knob and having engagement surfaces, respectively which form said preventing means in conjunction with said engagement protrusions of said change-over knob.

6. An idling device as set forth in claim 5, wherein said manually operatable knob is further formed in said cavity with stoppers to be engaged with said protrusions of said change-over knob for preventing excess release of said braking assembly.

7. An idling device as set forth in claim 6, wherein said stoppers are formed by remaining portions produced by said engagement recesses in said manually operatable knob.

8. An idling device as set forth in claim 1, wherein said change-over knob is fitted on a knob guide against rotation but axially slidably relative thereto, and said knob guide is fitted on said driving shaft against rotation and clamped by a support member fitted on the driving shaft, said change-over knob is formed with a cavity for snugly receiving said support member and position determining means is provided between said change-over knob and said support member for determining idling and non-idling positions of said change-over knob.

9. An idling device as set forth in claim 8, wherein said support member is formed in its outer circumferential surface with an annular groove in which a partially cut-off annular metal spring is fitted, and said change-over knob is provided with two annular engagement grooves in said cavity for receiving said spring for determining the idling and non-idling positions of the change-over knob.

* * * * *